US009359723B2

(12) United States Patent
Walkenhaus et al.

(10) Patent No.: US 9,359,723 B2
(45) Date of Patent: Jun. 7, 2016

(54) MACHINE FOR PRODUCING FIBER-CONTAINING WEB MATERIAL, IN PARTICULAR TISSUE PAPER

(71) Applicant: VOITH PATENT GMBH, Heidenheim (DE)

(72) Inventors: Hubert Walkenhaus, Kerpen (DE); Johan Einarsson, Ulm (DE); Ademar Lippi Alves Fernandes, Me Brummen (NL)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/363,849

(22) PCT Filed: Dec. 7, 2012

(86) PCT No.: PCT/EP2012/074780

§ 371 (c)(1),
(2) Date: Jun. 9, 2014

(87) PCT Pub. No.: WO2013/083773

PCT Pub. Date: Jun. 13, 2013

(65) Prior Publication Data

US 2014/0345822 A1 Nov. 27, 2014

(30) Foreign Application Priority Data

Dec. 8, 2011 (DE) ..... 10 2011 087 983
Dec. 8, 2011 (DE) ..... 10 2011 087 986

(51) Int. Cl.

| | |
|---|---|
| ***D21F 3/04*** | (2006.01) |
| ***D21F 3/02*** | (2006.01) |
| ***D21F 1/80*** | (2006.01) |

(Continued)

(52) U.S. Cl.
CPC ..... *D21F 1/80* (2013.01); *D21F 3/0209* (2013.01); *D21F 3/0272* (2013.01); *D21F 3/045* (2013.01); *D21F 7/086* (2013.01); *D21F 11/14* (2013.01)

(58) Field of Classification Search
CPC ..... D21F 3/0272; D21F 3/0209; D21F 1/48; D21F 1/80; D21F 3/029; D21F 3/045; D21F 7/086; Y10S 162/90
See application file for complete search history.

(56) References Cited

U.S. PATENT DOCUMENTS 7,285,185 B2 * 10/2007 Inoue et al. ..... 162/306
7,297,233 B2 * 11/2007 Herman et al. ..... 162/358.1

(Continued)

FOREIGN PATENT DOCUMENTS

DE 102011007568 A1 * 10/2012
EP 1518960 A1 3/2005

(Continued)

*Primary Examiner* — Jose Fortuna
(74) *Attorney, Agent, or Firm* — Laurence A. Greenberg; Werner H. Stemer; Ralph E. Locher

(57) ABSTRACT

A machine for producing fiber-containing web material, in particular tissue paper, includes a permeable dewatering belt for transporting fiber-containing source material used for producing web material from a forming section to a suction/pressing section, and a press belt assembly assigned to the suction/pressing section. The source material is received in the suction/pressing section between the press belt assembly and the dewatering belt and the press belt assembly presses the source material and the dewatering belt against a suction assembly of the suction/pressing section. The press belt assembly has a single press belt providing a source material contact surface.

15 Claims, 2 Drawing Sheets

(51) Int. Cl.
*D21F 11/14* (2006.01)
*D21F 7/08* (2006.01)

(56) References Cited

U.S. PATENT DOCUMENTS

| | | | | |
|---|---|---|---|---|
| 7,476,293 | B2 * | 1/2009 | Herman et al. | 162/206 |
| 7,476,294 | B2 * | 1/2009 | Herman et al. | 162/206 |
| 7,510,631 | B2 * | 3/2009 | Scherb et al. | 162/358.1 |
| 7,513,277 | B2 * | 4/2009 | Crook et al. | 139/383 AA |
| 7,550,061 | B2 * | 6/2009 | Walkenhaus et al. | 162/358.1 |
| 7,615,136 | B2 | 11/2009 | Silva | |
| 7,815,773 | B2 * | 10/2010 | Herman et al. | 162/205 |
| 7,842,166 | B2 * | 11/2010 | Herman et al. | 162/358.3 |
| 7,927,462 | B2 * | 4/2011 | Scherb et al. | 162/358.3 |
| 7,931,781 | B2 * | 4/2011 | Scherb et al. | 162/358.5 |
| 7,951,269 | B2 * | 5/2011 | Herman et al. | 162/358.3 |
| 8,075,739 | B2 * | 12/2011 | Scherb et al. | 162/358.5 |
| 8,092,652 | B2 * | 1/2012 | Scherb et al. | 162/206 |
| 8,118,979 | B2 * | 2/2012 | Herman et al. | 162/206 |
| 8,216,427 | B2 * | 7/2012 | Klerelid et al. | 162/358.2 |
| 8,236,140 | B2 * | 8/2012 | Scherb et al. | 162/358.3 |
| 8,440,055 | B2 * | 5/2013 | Scherb et al. | 162/206 |
| 8,608,909 | B2 * | 12/2013 | Scherb et al. | 162/358.4 |
| 9,145,643 | B2 * | 9/2015 | Inoue | D21F 7/086 |
| 9,157,185 | B2 * | 10/2015 | Inoue | D21F 7/086 |
| 2005/0167067 | A1 * | 8/2005 | Crook et al. | 162/348 |
| 2007/0068645 | A1 | 3/2007 | Silva | |
| 2007/0251659 | A1 | 11/2007 | Fernandes et al. | |
| 2007/0272386 | A1 * | 11/2007 | Scherb et al. | 162/358.4 |
| 2010/0193149 | A1 * | 8/2010 | Quigley | 162/358.1 |
| 2011/0155340 | A1 * | 6/2011 | Quigley | 162/205 |
| 2014/0053997 | A1 * | 2/2014 | Silva et al. | 162/210 |
| 2014/0345822 | A1 * | 11/2014 | Walkenhaus et al. | 162/358.2 |

FOREIGN PATENT DOCUMENTS

| | | | |
|---|---|---|---|
| WO | WO 2005075732 | A2 * | 8/2005 |
| WO | WO 2005075736 | A2 * | 8/2005 |
| WO | WO 2006045689 | A1 * | 5/2006 |
| WO | 2012143163 | A1 | 10/2012 |

* cited by examiner

MACHINE FOR PRODUCING FIBER-CONTAINING WEB MATERIAL, IN PARTICULAR TISSUE PAPER

BACKGROUND OF THE INVENTION

Field of the Invention

The present invention relates to a machine for producing fiber-containing web material, in particular tissue paper, comprising a permeable dewatering belt for transporting fiber-containing source material used for producing web material from a forming section to a suction/pressing section as well as a press belt arrangement assigned to the suction/pressing section, the source material being received in the suction/pressing section between the press belt arrangement and the dewatering belt and the press belt arrangement pressing the source material and the dewatering belt against a suction arrangement of the suction/pressing section.

The invention further relates to a press belt for producing fiber-containing web material, in particular tissue paper, in particular in a machine comprising a permeable dewatering belt for transporting fiber-containing source material used for producing web material from a forming section to a suction/pressing section as well as a press belt arrangement assigned to the suction/pressing section, the source material being received in the suction/pressing section between the press belt arrangement and the dewatering belt and the press belt arrangement pressing the source material and the dewatering belt against a suction arrangement of the suction/pressing section.

US 2007/0068645 A1 discloses a machine for producing fiber-containing web material, in particular so-called tissue paper. Such tissue paper, when compared with paper used as writing material or packaging material, for example, has a considerably higher pore volume proportion or heavier surface texturing, for example in order to achieve better absorbency and better wiping performance for domestic use. The general principle of US 2007/0068645 will now be described below with reference to FIG. 1 of the present application. In order to obtain this structure of the tissue paper, in the prior art machine 10, the source material, that is to say the pulp, for the web material to be produced is deposited in a forming section 12 on a dewatering belt 14 that is embodied in endless configuration, for example designed as a so-called forming fabric, and is moved in a transport direction L over a suction device 16 arranged on the rear side of the dewatering belt 14 in the direction of a suction/pressing section 18. This suction/pressing section 18 comprises a press belt arrangement 20 with two press belts 22, 24 nested inside one another. The source material for the web material 26 to be produced is received in a sandwich-like manner between the outer of these two press belts, that is to say the press belt 22, and the dewatering belt 14, in the suction/pressing section 18. In this configuration, the source material is able to move via a suction arrangement of the suction/pressing section 18 which is generally designated with 28. This suction arrangement 28 can comprise a roll-like element, for example, on the internal volume region of which a negative pressure is produced in order to extract liquid, in general water, from the source material and through the dewatering belt 14. After passing through the suction/pressing section 18, the web material 26 to be produced is moved through a press nip 28 between the suction/pressing arrangement 18 and a drying cylinder or Yankee cylinder 30.

A significant influence is made on the structuring or texturing of the web material 26 in the suction/pressing section 18. For this purpose, the dewatering belt 14 can be provided, for example, with a comparatively coarse, rough or heavy surface-structured form, for example a woven-fabric belt. In the press belt arrangement 20 the press belt 22 provided externally essentially assumes the task of producing a surface texturing in the web material 26. The press belt 24 running inside the press belt 22 and guided together with it in some areas over deflection rollers is essentially intended to provide the necessary contact pressure against the suction arrangement 28. For this purpose, this press belt 24 can be subjected to a tension of up to 8 kN/m, for example.

In this familiar machine 10, the tasks of producing a texturing of the web material 26 on the one hand and of producing the necessary contact pressure on the other hand are divided between two press belts.

BRIEF SUMMARY OF THE INVENTION

The object of the present invention is to make available a machine for producing fiber-containing web material, in particular tissue paper, by means of which, with a simplified construction in particular in a suction/pressing section, the structuring of the produced web material can be influenced in a defined manner.

According to the invention, this object is accomplished by a machine for producing fiber-containing web material, in particular tissue paper, comprising a permeable dewatering belt for transporting fiber-containing source material used for producing web material from a forming section to a suction/pressing section as well as a press belt arrangement assigned to the suction/pressing section, the source material being received in the suction/pressing section between the press belt arrangement and the dewatering belt and the press belt arrangement pressing the source material and the dewatering belt against a suction arrangement of the suction/pressing section.

It is also proposed that the press belt arrangement comprises a single press belt providing a source material contact surface.

In the construction according to the invention for the production of tissue paper or in a machine intended for that purpose, only a single press belt is used in the suction/pressing section, rather than a plurality of press belts that are nested inside one another and in each case take on subtasks. This provides both the source material contact surface and the necessary contact pressure against a suction arrangement of the suction/pressing section. The construction of the press belt arrangement or the suction/pressing section can be greatly simplified in this way, since only a single press belt and consequently driving or deflection elements for only a single press belt must be provided.

Especially if a web material with a comparatively fine surface structure, that is to say smoother tissue paper, is to be produced with the machine according to the invention, it is proposed that the press belt is constructed from yarn or/and fibrous material in the region of its source material contact surface, of which at least 60%, preferably at least 80%, and most preferably approximately 100%, exhibits a fineness of between 44 dtex and 1.7 dtex, preferably at most 17 dtex, and more preferably at most 11 dtex or at most only 6 dtex, and quite preferably at most 3 dtex. This ensures that a comparatively large proportion of the yarn or fibrous materials that are present in the region of the source material contact surface exhibits a comparatively high fineness, which results in a correspondingly fine structuring of the web material. A homogeneous transfer of pressure through the structure can be achieved by the appropriate choice of the yarn or fibrous material.

As an alternative or in addition, it can also be proposed for this purpose that the press belt is constructed with yarn or/and fibrous material in the region of its source material contact surface, of which at least 60%, preferably at least 80%, and most preferably approximately 100%, has a minimum cross-measurement of at most 70 μm, preferably at most 27 μm, and even more preferably at most 23 μm, and most preferably at most 13 μm. With such a fine structuring of the press belt on its source material contact surface, importance is attached less to the attainment of the heaviest possible texturing of the web material to be produced, and more to the dewatering performance in the region of the suction/pressing section, so that a very high proportion of the liquid contained in the source material for the web material can already be obtained at that point.

This comparatively fine surface structure of the press belt, albeit with high tensile strength, for the generation of the necessary contact pressure can be obtained by the press belt comprising a basic structure and at least one support layer on the basic structure, the source material contact surface being provided on a support layer.

In order to arrange a single press belt in a constructively simple manner in a suction/pressing section in the embodiment of a machine according to the invention in such a way that, on the one hand, it is able to generate the desired surface texturing in the web material to be produced, and, on the other hand, it also exhibits the necessary strength, it is proposed that the press belt comprises a basic structure in the form of a porous textile surface construction, whereby the basic structure can be constructed especially from:

a woven fabric, or/and
a laid scrim, or/and
a warp-knitted fabric, or/and
a spiral link structure, or/and
a gauze fabric, or/and
a film.

A construction for taking up the load or a significant part of the load that is present in a longitudinal direction of the belt, which also experiences a comparatively small elongation under heavy tensile loading and consequently ensures constant pressing conditions throughout the operational life, is provided with embodiments of this kind of the basic structure. It should be made clear at this point that the basic structure can, of course, also comprise a plurality of layers of the previously described type of construction. In the case of a construction as a woven fabric, for example, the woven fabric itself can thus be of multi-layer construction, that is to say, for example, with a plurality of layers of threads running in a longitudinal direction or/and with a plurality of layers of threads running in a transverse direction. Combinations of different structures are also possible. The use of a film having defined or undefined openings for producing fluid permeability is in fact in pronounced contrast with the use of a woven fabric. Even if the properties are different, however, the use of a film offers entirely characteristic advantages compared with a woven fabric.

If it is wished to obtain a comparatively coarse texturing of the web material to be produced, it is advantageous if the basic structure provides the source material contact surface.

As previously explained, in the construction according to the invention, the single press belt that is present there in a suction/pressing section must also take up the prevailing tensile loading, in particular in the longitudinal direction of the belt, in order to provide the necessary contact pressure. It is advantageous for this purpose if the basic structure is designed with structural elements with polyester material, preferably PET material, or/and PA material or/and PEEK material. The materials Nomex, Kevlar and related types of material also offer considerable advantage here. These are construction materials, which also experience a relatively small longitudinal elongation in the presence of comparatively heavy tensile loading and consequently ensure constant working conditions consistently throughout the operational life. In this case, every single one of the aforementioned materials has its own characteristic advantages, although these must be bought in part, however, at the expense of other disadvantages or particularly high costs.

In particular when the basic structure is constructed with threads, that is to say, for example as a woven fabric, a laid scrim or a warp-knitted fabric, these threads can be constructed as monofilament yarns, multifilament yarns or twines or combinations thereof.

In order to influence the texturing of the web material to be produced or/and the air permeability of the individual press belt to be provided in a suction/pressing section according to the invention, it is further proposed that at least one support layer is present on the basic structure, the source material contact surface being provided on a support layer. Provision can be made in this case, for example, for at least one support layer to be configured with:

a fibrous material layer,
a laid scrim layer,
a membrane layer.

It should be made clear at this point that combinations of a plurality of supporting layers, possibly including layers of different embodiments, are also possible here, of course.

In order further to increase the structural strength of the press belt, in particular in a longitudinal direction of the belt, it is proposed that at least one support layer comprises structural strength elements running in a longitudinal direction of the belt. These can be laid scrim yarns, for example, in an embodiment as or with a laid scrim running in a longitudinal direction of the belt. In an embodiment as or with a membrane, yarns or threads can be incorporated into into the membrane, which then preferably also extend in the longitudinal direction of the belt.

Especially the dewatering performance in the suction/pressing section can be influenced by coating or/and impregnating at least one support layer at least in some areas with a permeability influencing material.

In order to obtain a comparatively high dewatering performance, it is further proposed that the press belt has an air permeability of at least 15 cfm, more preferably at least 20 cfm, or at least 25 cfm, it being preferable for the permeability to air even to lie in a region of at least 50 cfm and ideally even at least above 80 cfm. A comparatively high air permeability ensures that, as a result of the high air throughput, a correspondingly high proportion of liquid can also be extracted from the construction material.

In order to be able to adjust the dewatering performance in a particularly advantageous manner with the single press belt intended to be used according to the invention, it is proposed that the press belt has an air permeability of at the very most 1200 cfm, at most 700 cfm to 800 cfm, preferably at most 500 cfm to 600 cfm, and most preferably in the range of 200 to 400 cfm.

In order, throughout the operational life, on the one hand to obtain a uniform structuring or texturing of the web material to be produced, and on the other hand to press out the liquid contained therein, it is proposed that the press belt exhibits a tensile strength in a longitudinal direction of the belt of at least 20 kN/m, preferably at least 50 kN/m, and most preferably at least 70 kN/m. In the case of such high tension ranges, and at any rate novel tension ranges in the paper industry, a person skilled in the art will naturally no longer think about the production of particularly voluminous fibrous material webs, in particular tissue webs. It has emerged as a complete surprise, however, in the course of experiments that particularly soft and fluffy, yet durable, tissue webs can be produced under this extreme pressure.

A further influence on the surface texturing of the web materials to be produced can be achieved in that the press belt exhibits a source material contact surface of at least 15%, preferably at least 25%, and most preferably at least 30%.

It should be made clear at this point that the source material contact surface is the surface area in relation to the entire surface area of the press belt which, in the suction/pressing section, enters into pressing contact with the web material to be produced or with the source material for that purpose. These are in particular the regions of the surface area, in which prominent protrusions are present in the press belt in the direction of the source material, for example at bending points of the yarns that are present in a woven fabric structure.

For the purpose of lowering the viscosity of the liquid to be removed in a suction/pressing section, it is possible among other things to proceed with the use of hot air, which is sucked through the press belt, the source material and the dewatering belt by means of the suction arrangement. In order to avoid structural damage to the press belt in the course of the thermal interaction with this air, it is proposed that the press belt is temperature-stable up to a temperature of 70° C., preferably 80° C., and most preferably 90° C. This means that, for the limit value indicated in each case, the construction material of the press belt is present in a configuration that remains essentially unchanged by comparison with lower temperatures and, in particular, is not transformed into a free-flowing state configuration.

It is advantageous, furthermore, if the press belt has a thickness of at most 5 mm, preferably at most 3 mm, and most preferably at most 2 mm.

The object of the invention is accomplished, furthermore, by a press belt for producing fiber-containing web material, in particular tissue paper, in particular in a machine comprising a permeable dewatering belt for transporting fiber-containing source material used for producing web material from a forming section to a suction/pressing section, as well as a press belt arrangement assigned to the suction/pressing section, the source material being received in the suction/pressing section between the press belt arrangement and the dewatering belt and the press belt arrangement pressing the source material and the dewatering belt against a suction arrangement of the suction/pressing section, in such a way that it is characterized in that the press belt has a tensile strength of at least 20 kN/m, preferably at least 30 kN/m, even more preferably at least 50 kN/m and most preferably at least 70 kN/m in a longitudinal direction of the belt, and comprises a source material contact surface.

The press belt advantageously exhibits an air permeability of at least 15 cfm, preferably at least 50 cfm, and most preferably at least 80 cfm.

In other cases it may be be preferable, on the other hand, for the press belt to exhibit an air permeability of at the very most 1200 cfm, of at most 700 cfm to 800 cfm, preferably at most 500 cfm to 600 cfm, and most preferably in the range of 200 to 400 cfm.

Since, on the one hand, a minimum value and, on the other hand, a maximum value is described, a combination of both guidelines is naturally also possible.

It is also preferable for the press belt to be suitable for operation as a single press belt inside a press belt arrangement assigned to a suction/pressing section.

The corresponding advantages of a press belt according to the invention can be found from the description of the invention in conjunction with the claimed machine, and there is no need for them to be repeated here unnecessarily. It goes without saying that the claimed press belt for achieving the advantages described at the appropriate points can also be modified according to the other preferred embodiments of the machine according to the invention.

In summary, it can thus be established that the invention makes available a machine and a press belt for producing web materials, in particular tissue webs, which permit the tissue web to be processed inside a press section by a single press belt, which provides a source material contact surface. The press belt can have at least one support layer, which comes into contact with the web to be processed or produced or can consist solely of a basic structure, which then also provides the source material contact surface. If the press belt includes a supporting layer, so that it can be identified as a press felt, it should preferably be characterized by a minimum permeability of at least 15 cfm. If the press belt is a belt or, as the case may be, a screen that is characterized by an uncoated basic structure, it is preferable for the press belt to have a maximum permeability of 1200 cfm.

In both cases, however, it is characteristic of especially preferred embodiments of the invention that the press belt can be operated under high tensile loads of more than 20 kN/m and, in entirely preferred embodiments, even up to and beyond 70 kN/m inside a machine and in contact with a material web to be produced. What is more, the press belt also automatically exhibits, in addition to the already described source material contact surface, a contact surface in direct contact with the machine as a single press belt that is present inside a press belt arrangement.

BRIEF DESCRIPTION OF THE SEVERAL VIEWS OF THE DRAWING

The present invention is described in detail below with reference to the accompanying figures, in which.

DESCRIPTION OF THE INVENTION

Figure 1:
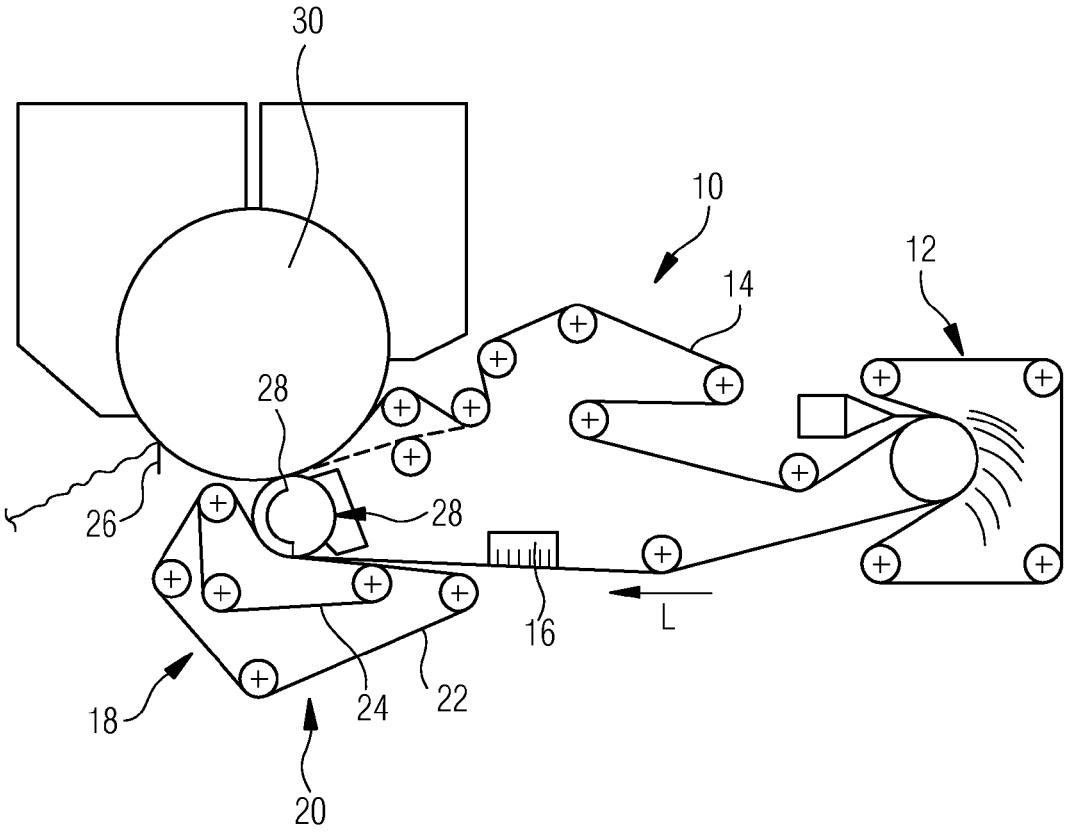
Fig.1 Prior Art
FIG. 1 depicts a representation in principle of the construction of a machine that is known from the prior art for producing in particular tissue paper.

The construction of a machine for producing web material, in particular tissue paper, embodied according to the invention is described below with reference to FIGS. 2 and 3, whereby the fundamental construction of a machine 10 of this kind can be effected in a manner as illustrated in FIG. 1 and described above. Essential aspects for the explanation of the principles of the present invention are illustrated In FIGS. 2 and 3.

Figure 2:
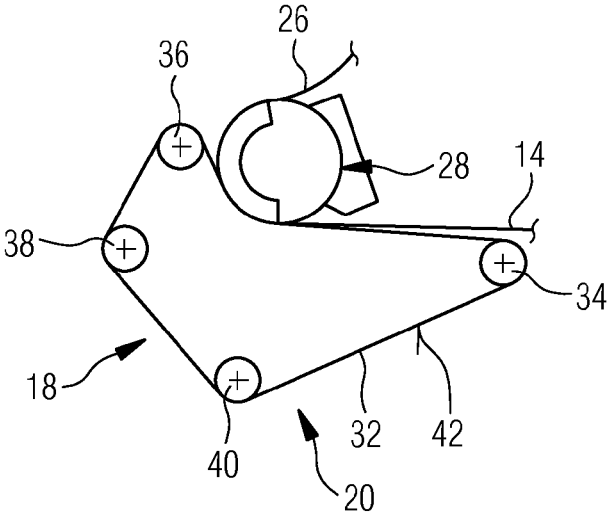
FIG. 2 depicts an embodiment according to the invention of a suction/pressing section of a machine for producing web material, in particular tissue paper.
Figure 3:
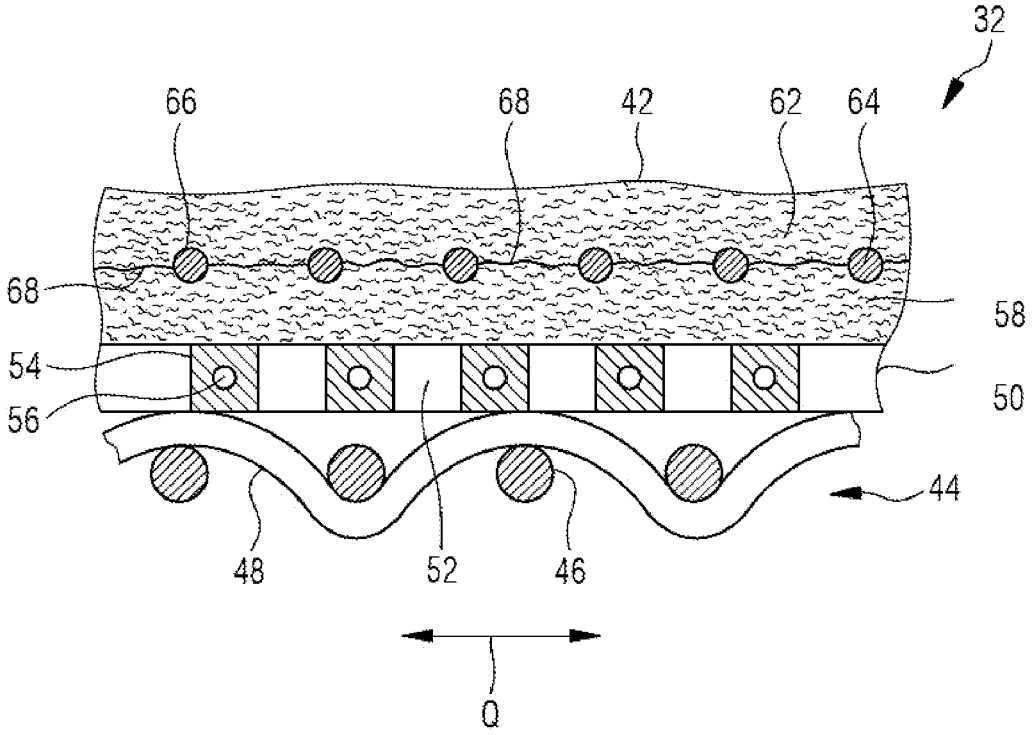
FIG. 3 depicts a cross section of a press belt used in the suction/pressing section in FIG. 2.

FIG. 2 depicts the suction/pressing section 18 of a machine 10 constructed according to the invention with the press belt arrangement 20 provided therein. In contrast to the characterizing features that are familiar from the prior art, in which both of the press belts 22, 24 nested inside one another that are distinguishable in FIG. 1 are used, only a single press belt 32 is proposed in the construction according to the invention. This is guided over a plurality of deflection rollers or drive rollers 34, 36, 38, 40, in such a way that, in a peripheral region of the suction arrangement 28, it presses the source material for the web material 26 to be produced and also the dewatering belt 14 against the outer periphery of the same. It should, of course, be made clear at this point that the geometrical configuration that can be appreciated in FIG. 2, which is produced essentially through the positioning of the various rolls 34 to 40, could be provided in some other way.

The fact that the press belt arrangement 20 in the construction according to the invention comprises only a single press belt 32, means that its embodiment is significantly more cost-effective, since not only a single belt needs to be provided, but also the deflection rollers or drive rollers for only a single belt need to be provided.

In order to be able to meet the requirements which arise during operation with this single press belt, the latter is configured in the manner described below. These requirements comprise the provision of an adequately high contact pressure, with which the source material for the web material 26 together with the dewatering belt 14 is pressed against the outer periphery of the suction arrangement 28. This means that the single press belt 32 must exhibit an adequately high tensile strength to assure an adequate stability with the smallest possible longitudinal elongation throughout the operational life, including under corresponding tension. For this purpose the press belt 32 can be provided with a tensile strength, which in the ideal case amounts to at least 30 kN/m, in order to be able to mount it in the suction/pressing section with adequate tension. It is preferable, however, that the aforementioned 30 kN/m tensile strength is considerably exceeded by the press belt according to the invention and that it withstands a continuous tensile loading of more than 50 kN/m or even more than 70 kN/m.

The single press belt 32 must, in addition to the tensile strength previously mentioned above, also exhibit a corresponding texture on its source material contact surface 42 situated externally in FIG. 2, especially if comparatively heavy texturing of the same takes prominence during the production of the web material 26. This structure of the press belt 32 is transferred in the course of the sandwich-like accommodation of the source material between the latter and the dewatering belt 14 on the source material and is as such reproduced at least partially in the web material 26.

One example of the construction of the press belt 32 is described below with reference to FIG. 3.

A cross section, that is to say a section through the press belt 32 in a transverse direction of the belt Q, is illustrated in the form of a detailed enlargement in FIG. 3. It should be pointed out that the longitudinal direction of the belt is positioned orthogonally to this transverse direction of the belt Q and, in the representation in FIG. 3, is accordingly positioned orthogonally in relation to the plane of the drawing. This longitudinal direction of the belt also corresponds to the transport direction L that can be identified in FIG. 1, but without intending to make any statement about its orientation.

The press belt 32 has a basic structure 44 as an essential part of the system, in particular providing the necessary tensile strength in a definitive manner. This is constructed in the illustrated example as a woven fabric having longitudinal threads 46 running in the longitudinal direction of the belt and transverse threads 48 interwoven therewith and extending in the transverse direction of the belt Q. For example, the longitudinal threads 46 can be warp threads and the transverse threads 48 can be weft threads. This embodiment is particularly useful when the basic structure 24 is not produced in an endless manner, but is woven as a belt section having end areas which require to be connected together. The longitudinal threads 46 can also be the weft threads and the transverse threads 48 can also be the warp threads, especially when the basic structure 44 is required to be provided as an endless structure already in the weaving process.

The weave for the basic structure 24 can be selected freely. Especially in the case of a corresponding strength requirement, a plurality of woven fabric layers can also be connected together structurally. The use of so-called gauze fabric is also conceivable. The weave can be open or endless, for example.

As an alternative to the construction of the basic structure 44 as a woven fabric, this could also be constructed, for example, as a spiral or helical twisted yarn or laid scrim, whereby, as a result of this spiral or helical twisting, the one or more yarns providing the basic structure 44 also extend essentially in the longitudinal direction of the belt and in so doing ensure its structural strength. The use of a warp-knitted fabric as a basic structure is also conceivable, and likewise the use of a so-called spiral link structure or spiral screen structure. At the same time, spiral or helically twisted spiral members extending in the transverse direction of the belt Q are arranged overlapping one another and are bound together by connecting threads or wires engaging in the overlapping region in the manner of a chain structure.

Because of its high tensile strength, polyester material in particular, for example PET material, is particularly advantageous as a construction material for the structural elements, that is to say threads or yarns or spiral members of the basic structure 24. As an alternative, it is also possible to use PA material, PEEK material or other suitable materials, in particular such as the aforementioned Nomex or Kevlar materials. A further advantage of this construction material, in addition to the achievement of a correspondingly high tensile strength, lies in the fact that it is temperature-stable at temperatures of up to 90° C., that is to say it experiences only a very small change influencing the strength of the same. This is important because of the possibility of using hot air in a suction/pressing section 18 intended for improving the dewatering performance, which can lead to corresponding heating of the press belt 32.

Furthermore, yarns or threads can be used as monofilaments, multifilaments or twines in the construction of the basic structure 44. Combinations of these types of yarn or thread are also possible, so that the longitudinal threads 46 and the transverse threads 48, for example, are of different execution in respect of their structure or/and also their construction material. Different woven fabric layers can also be configured with different types of yarns or construction materials in the case of a multi-layered construction, for example a woven fabric structure.

If, in the case of a machine 10 constructed according to the invention, a comparatively coarse structure of the web material 26 to be produced is required to be achieved, the press belt 32 can be constructed, for example, in such a way that the source material contact surface, that is to say the surface of the same, with which the source material introduced via the dewatering belt 14 comes into contact or is pressed against the dewatering belt 14, is provided by the basic structure 44. This means, for example, that the press belt 32 comprises only the basic structure 44. If necessary, this could be coated on its running side, that is to say on the side which lies remote from the source material, with at least one layer for increasing the resistance to wear.

Making the source material contact surface available on the basic structure 44 itself ensures that the press belts, for example in the region of the bending points of the interwoven yarns or threads, are impressed into the source material and consequently lead to a comparatively heavy texturing of the same.

It is also possible in such an embodiment of the press belt 32 with a comparatively strongly structured source material contact surface to ensure that the contact surface, with which the source material makes contact and is pressed directly against the dewatering belt 14, can lie in the range of 30% and above of the entire surface of the press belt 32.

In order to achieve a rather finer texturing of the web material 26 to be produced with the construction according to the invention, it is possible to provide at least one support layer on the basic structure 44. In the example illustrated in FIG. 3, four support layers of this kind in total are present, of which the layering or also the provision are shown here only by way of example.

Provided immediately after the basic structure 44 is a support layer 50 of membrane-like configuration. This can fundamentally comprise a lattice-like structure with, for example, polygonal, preferably rectangular or square mesh openings 52, in order to achieve the necessary air permeability. Elliptical, in particular circular, mesh openings or irregularly shaped mesh openings are also conceivable. Yarns 56 can be provided as the structural strength elements for increasing the longitudinal strength in the grid bars 54 extending in the longitudinal direction of the belt, which in turn can be configured as monofilaments, multifilaments or twines, for example.

The previously mentioned materials, in particular polyester material, such as PET material, can thus also be used for the construction of the support layer 50 with membrane-like configuration.

A support layer 58 configured with fibrous material is provided following the membrane-like support layer 50. This can be in the form of a nonwoven fabric or can be constructed with so-called staple fibers, the fibrous material that is used for this purpose itself being capable of being constructed with the previously mentioned construction materials, preferably polyester material. A support layer 64 configured as a laid scrim lies between this support layer 58 constructed with fibrous material and a further support layer 62 of a fibrous material providing the source material contact surface 42. This is provided on the adjacent boundary regions of the two support layers 58, 62 constructed with fibrous material or is received between these two support layers. This support layer 64 configured as laid scrim comprises a multiplicity of yarns or yarn sections 66 extending in the longitudinal direction of the belt, whereby the technical realization in this case too can also be effected with a spiral or helical configuration. This support layer 64 with the thread or yarn sections 66 extending essentially in the longitudinal direction of the belt also increases the structural strength in the longitudinal direction of the belt.

The strong cohesion of the various support layers 50, 58, 62 and 64 with one another and also with the basic structure 44 can be effected, for example, by needling. Other physical and/or chemical connection mechanisms, such as sewing or adhesive bonding, are also possible. It can also be of considerable advantage if the support layers 50, 58, 62 and 64 are connected with one another, the basic structure is connected in itself and/or both types are connected together by welding, in particular by ultrasonic welding. Ultrasonic welding permits high-precision processing, which was previously considered to be unsuitable, in particular in conjunction with the processing of supporting layers, but is especially preferred in conjunction with the present invention because of the desired extremely high tensile strengths in the press belt.

FIG. 3 illustrates, for instance and rather schematically, the construction of two different preferred embodiments.

In the first preferred embodiment it is preferably further provided in the case of the press belt 32 for the support layer 62 providing the source material contact surface 42 to be constructed with threads or fibers having a fineness of at most 6 dtex, preferably at most 3 dtex, whereby it is possible here to take account of the fact that, for example, a major proportion of these fibers, that is to say for example at least 60%, and preferably at least 80% thereof, are provided with the corresponding fineness. This corresponds, for example, to the use of fibers, of which the minimum cross-measurement is at most 70 μm, preferably at most 27 μm, and most preferably at most 23 μm. It should be made clear at this point that the minimum cross-measurement corresponds to the diameter, for example in the case of a circular cross section and, in the case of elliptical cross section geometry, corresponds to the minimum cross-measurement of twice the small half-axis of the ellipse. This means that, according to the invention, it is ensured that the surface roughness on the source material contact surface 42 is achieved with threads or fibers with a maximum of 3 dtex, for example.

It is also possible with the previously described construction, in particular the fineness of the supporting layer, which also provides the source material contact surface 42, to ensure an adequately high through-flow capability, that is to say permeability to air. This can lie in a region of at least 15 cfm, more preferably at least 20 cfm, or at least 25 cfm, whereby it is preferable that the permeability to air even lies in a region of at least 50 cfm and ideally even at least above 80 cfm, so that relatively high requirements are imposed in respect of the air permeability on the one hand and the comparatively low surface roughness on the other hand, which can nevertheless be realized with the construction according to the invention.

It can be further appreciated in FIG. 3 that material 68 influencing the permeability of the press belt 32 is provided in some areas in the boundary region between the two support layers 58, 62 that are constructed with fibrous material. This can be applied, for example, to the surface of the support layer 58 before the application of the support layer 64 or of the support layer 62, or it can also be introduced into the volume of the support layer 58. This thus ensures that this material 68 indeed influences the permeability to air, although essentially not the surface structuring in the region of the source material contact surface 42. This material can comprise silicon material, for example, or also polyurethane material combined with the fibers of the fibrous materials by fusing, which ultimately contributes to a reduction in the exposed volume area for the through-flow of air and is consequently able to lower the air permeability, while also being able to influence the stiffness of the press belt 32 advantageously at the same time. The use of other resin materials, such as acrylic resin materials, or the use of further methods of chemical treatment is also possible here, of course.

In conclusion, it should be pointed out that other possibilities for layering of the support layers and additional or also fewer support layers can, of course, be provided in the construction illustrated in FIG. 3. This will depend essentially on which structuring it is wished to achieve in the web material to be produced with the machine according to the invention, that is to say, for example, tissue paper. In addition, this will naturally depend fundamentally on which type, which quality, in which weight per unit area and from which available raw materials the web material is intended to be produced.

For the purpose of explaining the second preferred embodiment, it can be appreciated in FIG. 3, unlike the previously described design, that material 68 influencing the permeability of the press belt 32 is provided in some areas in the boundary region between the two support layers 58, 62 that are constructed with fibrous material. This can be applied, for example, to the surface of the support layer 58 before the application of the support layer 64 or the support layer 62, or it can also be introduced into the volume of the support layer 58. This thus ensures that this material 68 indeed influences the permeability to air, although essentially not the surface structuring in the region of the source material contact surface 42.

This material can comprise silicon material, for example, or also polyurethane material combined with the fibers of the fibrous material by fusing, which ultimately contributes to a reduction in the exposed volume area for the through-flow of air and is consequently able to lower the air permeability, while also being able to influence the stiffness of the press belt 32 advantageously at the same time. The use of other resin materials, such as acrylic resin materials, or the use of further methods of chemical treatment is also possible here, of course.

It is possible with the construction that can be appreciated in FIG. 3, for example, to achieve an air permeability of the press belt 32 of less than 1200 cfm or even less than 700 cfm to 800 cfm, preferably even only between approximately 200 cfm to 600 cfm or even only 200 cfm to 400 cfm. This is an air permeability which ensures a sufficiently good dewatering characteristic by the air that is drawn through the press belt 32 and, as a result, also through the source material, although it also provides an additional assurance, on the other hand, that the desired structuring characteristics can be achieved on the source material contact surface 42.

In conclusion, it should be pointed out that other possibilities for the layering of the support layers and additional or also fewer support layers can, of course, be provided in the construction illustrated in FIG. 3. This will depend essentially on the structuring that it is wished to achieve with the machine according to the invention in the web material to be produced, for example tissue paper.

The invention claimed is:

1. A machine for producing fiber-containing web material, the machine comprising:

a permeable dewatering belt for transporting fiber-containing source material for producing the web material from a forming section to a suction and pressing section, the suction and pressing section having a suction arrangement;

a press belt arrangement assigned to said suction and pressing section, said press belt arrangement having a single press belt forming a source material contact surface;

wherein said press belt is constructed with yarn and/or fibrous material at said source material contact surface, and wherein at least 60% of the yarn and/or fibrous material has a fineness of between 44 dtex and 1.7 dtex; and wherein the source material is received in said suction and pressing section between said press belt arrangement and said dewatering belt, and said press belt arrangement presses the source material and said dewatering belt against said suction arrangement of said suction and pressing section.

2. The machine according to claim 1, wherein substantially 100% of said yarn and/or fibrous material has a fineness of at most 3 dtex.

3. The machine according to claim 1, wherein said press belt comprises a basic structure formed of at least one material selected from the group consisting of:

a woven fabric, a laid scrim, a warp-knitted fabric, a gauze fabric, and a film.

4. The machine according to claim 3, wherein said basic structure provides said source material contact surface.

5. The machine according to claim 3, which comprises at least one support layer disposed on said basic structure, and wherein said source material contact surface is formed on said support layer.

6. The machine according to claim 5, wherein said at least one support layer is a layer selected from the group consisting of:

a fibrous material layer, a laid scrim layer, and a membrane layer.

7. The machine according to claim 5, wherein at least one said support layer comprises structural strength elements running in a longitudinal direction of said press belt.

8. The machine according to claim 1, wherein said press belt has an air permeability of at least 15 cfm.

9. The machine according to claim 8, wherein said press belt has an air permeability of at least 80 cfm.

10. The machine according to claim 1, wherein said press belt has an air permeability of at most 1200 cfm.

11. The machine according to claim 10, wherein said press belt has an air permeability in a range from 200 to 400 cfm.

12. The machine according to claim 1, wherein said press belt has a tensile strength, in a longitudinal direction of said belt, of at least 20 kN/m.

13. The machine according to claim 1, wherein the press belt has a source material contact surface of at least 15% of said press belt.

14. A machine for producing fiber-containing web material, the machine comprising:

a permeable dewatering belt for transporting fiber-containing source material for producing the web material from a forming section to a suction and pressing section, the suction and pressing section having a suction arrangement;

a press belt arrangement assigned to said suction and pressing section, said press belt arrangement having a single press belt forming a source material contact surface;

wherein said press belt is constructed with yarn or/and fibrous material at said source material contact surface, and wherein at least 60% of the yarn and/or fibrous material has a minimum cross-measurement of at most 70 μm; and wherein the source material is received in said suction and pressing section between said press belt arrangement and said dewatering belt, and said press belt arrangement presses the source material and said dewatering belt against said suction arrangement of said suction and pressing section.

15. The machine according to claim 14, wherein substantially 100% of the yarn and/or fibrous material has a minimum cross-measurement of no more than 13 μm.

* * * * *